US007829142B2

(12) United States Patent
Kool et al.

(10) Patent No.: US 7,829,142 B2
(45) Date of Patent: Nov. 9, 2010

(54) METHOD FOR ALUMINIZING SERPENTINE COOLING PASSAGES OF JET ENGINE BLADES

(75) Inventors: Lawrence Bernard Kool, Clifton Park, NY (US); Michael Howard Rucker, Cincinnati, OH (US)

(73) Assignee: General Electric Company, Niskayuna, NY (US)

( * ) Notice: Subject to any disclaimer, the term of this patent is extended or adjusted under 35 U.S.C. 154(b) by 1176 days.

(21) Appl. No.: 11/425,555

(22) Filed: Jun. 21, 2006

(65) Prior Publication Data

US 2007/0298166 A1 Dec. 27, 2007

(51) Int. Cl.
*B05D 3/02* (2006.01)
*B05D 7/22* (2006.01)
*B05D 7/14* (2006.01)

(52) U.S. Cl. ..... 427/229; 427/230; 427/232; 427/234; 427/235; 427/238; 427/239; 427/240; 427/349; 427/376.6; 427/376.8; 427/380

(58) Field of Classification Search ..... 427/230, 427/232, 234, 235, 238, 239, 240, 372.2, 427/380, 229, 349, 376.6, 376.8
See application file for complete search history.

(56) References Cited

U.S. PATENT DOCUMENTS

| | | | | |
|---|---|---|---|---|
| 4,208,454 | A | 6/1980 | Reed et al. | |
| 5,366,765 | A * | 11/1994 | Milaniak et al. | 427/229 |
| 5,650,235 | A * | 7/1997 | McMordie et al. | 428/610 |
| 6,413,582 | B1 * | 7/2002 | Park et al. | 427/235 |
| 6,805,906 | B2 * | 10/2004 | Moravek et al. | 427/229 |
| 2004/0047994 | A1 * | 3/2004 | Becker et al. | 427/346 |
| 2004/0115355 | A1 | 6/2004 | Bauer et al. | |
| 2005/0031781 | A1 | 2/2005 | Kool et al. | |
| 2005/0031782 | A1 * | 2/2005 | Foster | 427/240 |
| 2005/0031877 | A1 | 2/2005 | Gigliotti, Jr. et al. | |
| 2007/0298269 | A1 * | 12/2007 | Kool | 428/457 |

FOREIGN PATENT DOCUMENTS

| | | |
|---|---|---|
| EP | 1065296 | 1/2001 |
| EP | 1505176 | 2/2005 |
| EP | 1591552 A1 | 2/2005 |
| GB | 2058444 | 4/1981 |
| WO | 2007056156 | 5/2007 |

OTHER PUBLICATIONS

EP Search Report, EP07112484, Nov. 22, 2007.

* cited by examiner

*Primary Examiner*—Kirsten C Jolley
(74) *Attorney, Agent, or Firm*—Penny A. Clarke

(57) ABSTRACT

Disclosed herein is a method for aluminiding an internal passage of a metal substrate comprising injecting a slurry composition that comprises a powder comprising aluminum, a binder selected from the group consisting of colloidal silica, an organic resin, and a combination thereof, into the internal passage; applying compressed air to the internal passage to facilitate distribution of the slurry composition throughout the internal passage; and, heat treating the slurry composition under conditions sufficient to remove volatile components from the composition, and to cause diffusion of aluminum into a surface of the internal passage.

35 Claims, 2 Drawing Sheets

METHOD FOR ALUMINIZING SERPENTINE COOLING PASSAGES OF JET ENGINE BLADES

BACKGROUND

Figure 1:
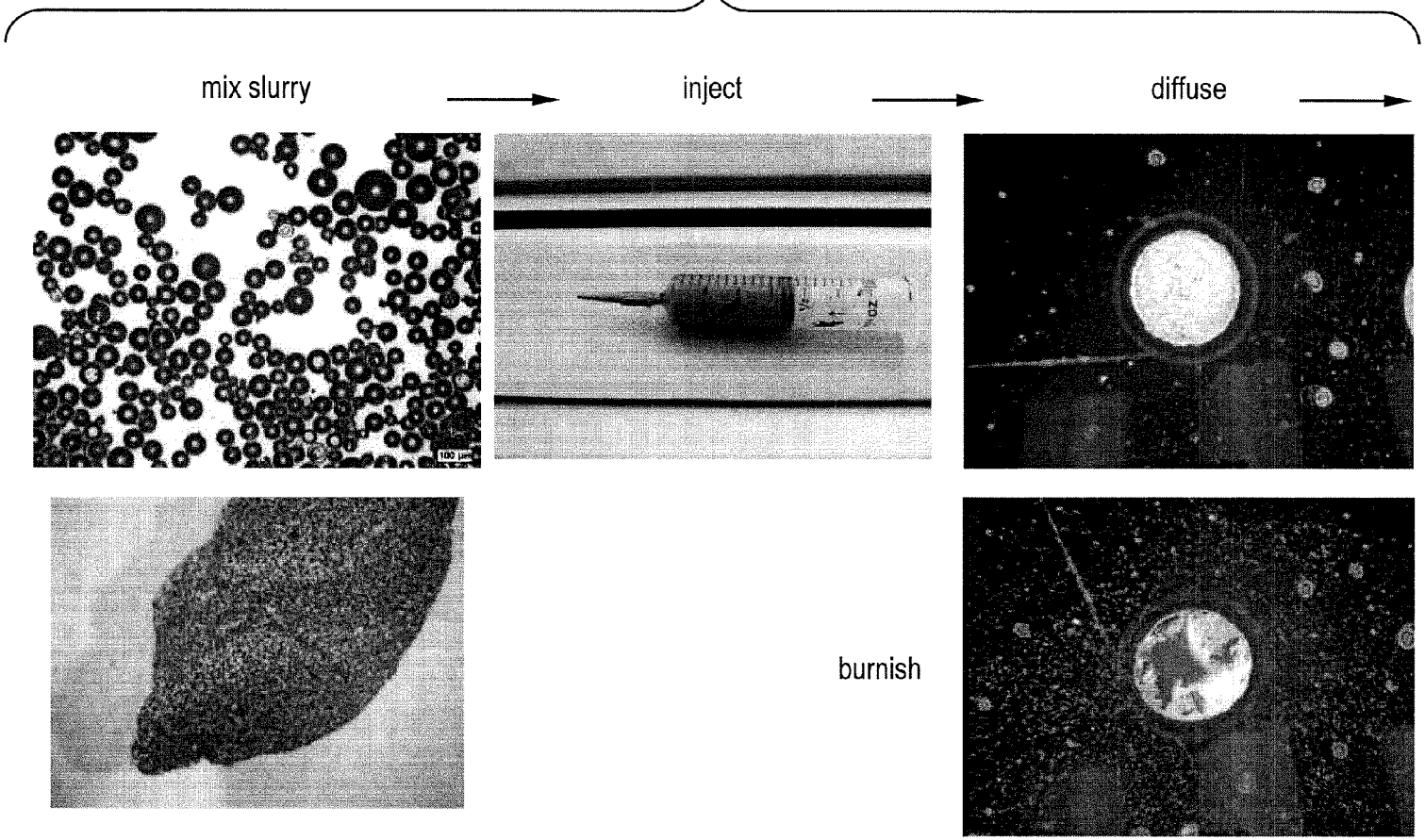

This disclosure relates generally to coating systems for protecting metals. More specifically, it is directed to slurry coating compositions for providing aluminum enrichment to the surface region of a metal substrate.

In the case of turbine engines, the substrate is often formed from a superalloy comprising cobalt or nickel. The term "superalloy" refers to complex alloys comprising cobalt or nickel that include one or more other elements such as aluminum, tungsten, molybdenum, titanium, and iron. The aluminum component imparts environmental resistance to the alloys, and can also improve their precipitation-strengthening properties.

Superalloy substrates are often coated with protective metallic coatings. One example of a protective metallic coating is an aluminide material, such as nickel-aluminide or platinum-nickel-aluminide.

If such superalloy substrates are exposed to an oxidizing atmosphere for an extended period of time, they can become depleted of aluminum. One method for increasing the aluminum content of the superalloy substrate is sometimes referred to as "aluminiding" or "aluminizing." The aluminum can be introduced into the substrate by a variety of techniques. In the "pack aluminiding" process, the substrate is immersed within a mixture (or pack) containing the coating element source, filler material, and a halide-activating agent. At high temperatures, for example at temperatures about 700° to about 750° C., reactions within the mixture yield an aluminum-rich vapor, which condenses onto the substrate surface. During a subsequent heat treatment, the condensed aluminum-based material diffuses into the substrate. In another method, the aluminum coating is applied by means of a high temperature chemical vapor deposition or any other gas phase means. These methods use high temperatures to vaporize the aluminum. In addition, aluminum is deposited on all exposed surfaces. The portions of the article not desired to be coated are protected with a high temperature resistant masking material. The masking process is time-consuming as a result of which vapor-phase methods are costly and time-consuming.

Internal passages are generally present in gas turbine components to allow for the passage of cooling air. As gas turbine temperatures have increased, the geometries of these cooling passages have become progressively more circuitous and complex. However, parts requiring internal aluminizing are treated with a vapor phase aluminizing process, which causes the parts to become expensive.

It would therefore be desirable to use a coating that can be easily and economically prepared and can further be applied to selected surfaces of an article. It would further be desirable to have a composition and method to facilitate aluminizing of internal cooling passages without requiring vapor phase aluminizing processes.

SUMMARY

Disclosed herein is a method for aluminiding an internal passage of a metal substrate comprising: injecting a slurry composition that comprises a powder comprising aluminum, a binder selected from the group consisting of colloidal silica, an organic resin, and a combination thereof, into the internal passage; applying compressed air to the internal passage to facilitate distribution of the slurry composition throughout the internal passage; and, heat treating the slurry composition under conditions sufficient to remove volatile components from the composition, and to cause diffusion of aluminum into a surface of the internal passage.

DETAILED DESCRIPTION OF FIGURES

Figure 2:
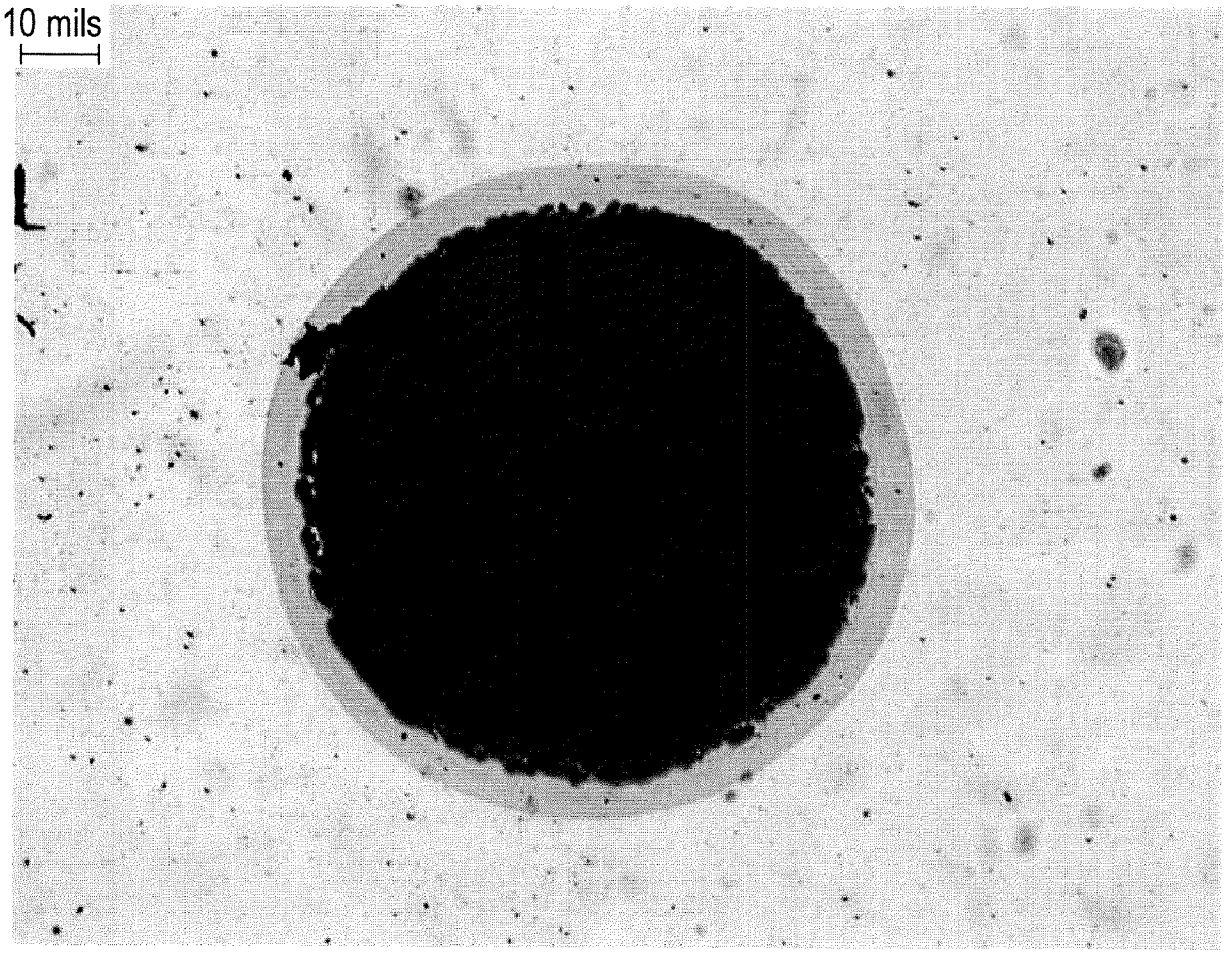

FIG. 1 depicts an exemplary embodiment of aluminizing an internal passage of a metal substrate; and FIG. 2 depicts an internal passage having a coating of substantially uniform thickness.

DETAILED DESCRIPTION

It is to be noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). It is to be noted that all ranges disclosed within this specification are inclusive and are independently combinable. The term "and/or" as used herein implies either or both. For example, if it is stated that A and/or B can be used, then it implies that A, B or both A and B can be used.

Disclosed herein is a method for producing an aluminide coating on internal surfaces of an article such as on internal surfaces of a cavity or a passage in an article. In one embodiment, the method is used to produce an aluminide coating on internal surfaces of serpentine cooling passages of jet engine blades. The method comprises creating a slurry; injecting the slurry into a passage of an article; blowing the injected slurry using a flow of compressed air, agitating the article into which the slurry has been injected, removing the excess slurry, heating, curing, and vacuum drying the slurry. In one embodiment, the method further comprises removing excess material from the internal passage. A residual slurry coating of substantially uniform thickness is provided by controlling the viscosity of the slurry and the processing conditions.

The slurry composition comprises a powder comprising aluminum, such as an aluminum powder or an aluminum-silicon alloy powder, a binder, and an optional stabilizer. In one embodiment, the slurry composition further comprises inert organic pyrolysable thickener particles that modify the viscosity of the slurry composition. The slurry composition is manufactured so that it can be distributed controllably with a flow of compressed air to provide a residual coating of uniform thickness.

In one embodiment, the slurry composition comprises an aluminum powder or an aluminum-silicon alloy powder, and a binder such as colloidal silica. In another embodiment, the slurry composition comprises an aluminum powder or an aluminum-silicon alloy powder, a binder such as colloidal silica, and an organic stabilizer such as glycerol.

The powder comprising aluminum as defined herein refers to an aluminum powder or an aluminum-silicon alloy powder. In one embodiment, the powder comprising aluminum is an aluminum-silicon alloy eutectic powder. The powder comprising aluminum has an average particle size of about 0.5 micrometer to about 200 micrometers measured across the longest axis of the particle. Specifically, the powder comprising aluminum has an average particle size of about 5 micrometers to about 100 micrometers measured across the longest axis of the particle. More specifically, the powder comprising aluminum has an average particle size of about 10 micrometers to about 50 micrometers measured across the longest axis of the particle. In one embodiment, the powder comprising aluminum is present in an amount of about 10% by weight to about 90% by weight, as a percentage of the entire composition. Specifically, the powder comprising aluminum is present in an amount of 20% by weight to about 80% by weight. More specifically, the powder comprising aluminum is present in an amount of about 30% by weight to about 70% by weight.

The slurry coating composition further comprises a powder comprising aluminum. This powder serves as the source of aluminum for the substrate. The powder comprising aluminum comprises various shapes of aluminum particles, such as, for example, spherical, hollow, porous, rod, plate, flake, fibrous, or irregularly shaped, as well as amorphous aluminum particles, or a combination comprising at least one of the foregoing shapes. In one embodiment, the powder comprising aluminum comprises spherical aluminum particles. In another embodiment, the powder comprising aluminum is in the form of a wire, for example, a wire mesh. The powder comprising aluminum can be obtained from a number of commercial sources, such as Valimet Corporation, Stockton, Calif.

The particles of the powder comprising aluminum can be used in a variety of sizes. The size of the powder particles will depend on several factors, such as the type of substrate; the technique by which the slurry is to be applied to the substrate; the identity of the other components present in the slurry; and the relative amounts of those components. The powder particles have an average particle size of about 0.5 micrometer to about 200 micrometers measured across the longest axis of the particle. Specifically, the powder particles have an average particle size of about 5 micrometers to about 100 micrometers measured across the longest axis of the particle. More specifically, the average particle size is of about 10 micrometers to about 50 micrometers measured across the longest axis of the particle. The powder particles are produced by suitable techniques such as a gas atomization process or a rotating electrode technique.

As used herein, a "powder comprising aluminum" is defined as one that comprises greater than or equal to about 75% by weight aluminum. Specifically, the powder comprising aluminum comprises greater than or equal to about 85% by weight aluminum. More specifically, the powder comprising aluminum comprises greater than or equal to about 95% by weight aluminum. Thus, the powder comprising aluminum may comprise other elements that impart various characteristics to the substrate material, such as for example, enhanced oxidation resistance, phase stability, environmental resistance, and sulfidation resistance. For example, the powder comprising aluminum comprises a platinum group metal, such as platinum, palladium, ruthenium, rhodium, osmium, iridium, or a combination comprising one of the foregoing platinum group metals. In another example, the powder comprising aluminum comprises a rare earth metal including lanthanides such as lanthanum, cerium, and erbium, as well as elements that are chemically similar to the lanthanides, such as scandium and yttrium, or a combination comprising one of the foregoing elements. In some instances, the powder comprising aluminum may comprise iron, chromium, cobalt, or a combination comprising one of the foregoing. Moreover, the powder comprising aluminum may also contain various other elements and other materials at impurity levels, for example, less than about 1% by weight.

In one embodiment, the powder comprising aluminum is an aluminum-silicon alloy powder. In one embodiment, the aluminum-silicon alloy powder is an aluminum-silicon alloy eutectic powder. The aluminum-silicon alloy powder particles have an average particle size of about 0.5 micrometer to about 200 micrometers measured across the longest axis of the particle. Specifically, the powder particles have an average particle size of about 5 micrometers to about 100 micrometers. More specifically, the powder particles have an average particle size of about 10 micrometers to about 50 micrometers. The powder particles are produced by suitable techniques such as a gas atomization process or rotating electrode techniques. Suitable aluminum-silicon alloy powders are commercially available from Valimet Corporation.

The silicon in the aluminum-silicon alloy serves, in part, to decrease the melting point of the alloy, thereby facilitating the aluminiding process, as described below. Without being bound by theory, the silicon may also function as a passivating agent, so that the alloy is relatively stable in the presence of the colloidal silica. In one embodiment, the silicon is present in an amount sufficient to decrease the melting point of the aluminum-silicon alloy to below about 610° C. In one embodiment, the silicon is present in the alloy at a level of about 0.5% by weight to about 30% by weight, based on the combined weight of the silicon and aluminum. Specifically, the silicon is present in the alloy at a level of about 5% by weight to about 20% by weight, based on the combined weight of the silicon and aluminum. More specifically, the silicon is present at a level of about 10% by weight to about 15% by weight, based on the combined weight of the silicon and aluminum.

Table 1 describes some of the chemical and physical characteristics for several commercial grades of spherical, aluminum-silicon particles, available from Valimet Corporation. These grades of the aluminum-silicon alloy are merely exemplary, since many other types of these alloys could be used.

TABLE 1

| | S-10 Grade | S-20 Grade |
|---|---|---|
| Weight % | | |
| Aluminum | Balance | Balance |
| Silicon | 11.0%-13.0% | 11.0%-13.0% |
| Iron | 0-0.8% | 0-0.8% |
| Zinc | 0-0.2% | 0-0.2% |
| Oil/Grease | 0-0.2% | 0-0.2% |
| Volatile Components | 0-0.1% | 0-0.1% |
| Sieve Analysis | | |
| +140 | | 0-1.0% |
| +170 | | 0-7.0% |
| +200 | 0-0.1% | |
| +250 | 0-1.0% | |
| +325 | 0-15.0% | 90.0-100% |
| −325 | 85.0-100% | 0-10.0% |

The aluminum-silicon alloys may also comprise additional components that impart a variety of desired characteristics. Examples include the platinum group metals, rare earth metals (as well as Sc and Y), iron, chromium, cobalt, or a combination comprising at least one of the foregoing elements. A minor amount of an impurity is also sometimes present. For example, an impurity is present in an amount less than about 1% by weight, based on total elements present.

The composition of the powder comprising aluminum, and the composition of the slurry, depend in part on the amount of aluminum needed for the substrate. In one embodiment, the aluminum in the slurry coating composition will be present in an amount sufficient to compensate for any projected loss of aluminum from the substrate, under projected operating condition parameters. The operating condition parameters include temperature levels, temperature/time schedules and cycles; and environmental conditions.

In another embodiment, the amount of aluminum in the slurry composition is calculated to exceed the amount of aluminum present in the substrate by up to about 65 atomic %. Specifically, the amount of aluminum in the slurry composition is calculated to exceed the amount of aluminum present in the substrate by up to about 55 atomic %. More specifically, the amount of aluminum in the slurry composition is calculated to exceed the amount of aluminum present in the substrate by up to about 45 atomic %. In terms of weight percentages, the amount of aluminum in the slurry is about 0.5% by weight to about 50% by weight. Specifically, the amount of aluminum is of about 10% by weight to about 45% by weight. More specifically, the amount of aluminum is of about 30% by weight to about 40% by weight. Depending on the superalloy substrate, the aluminum levels may be adjusted further to allow for the presence of other metals intended for diffusion.

In one embodiment, the slurry coating composition comprises colloidal silica. The term "colloidal silica" as used herein refers to any dispersion of fine particles of silica in a medium of water or another solvent. Dispersions of colloidal silica are available from various chemical manufacturers, in either acidic or basic form. Moreover, various shapes of silica particles can be used, e.g., spherical, hollow, porous, rod, plate, flake, fibrous, or irregularly shaped as well as amorphous silica powder or a combination comprising at least one of the foregoing shapes. In one embodiment, the silica particles are spherical silica particles. The particles have an average particle size of about 10 nanometers to about 100 nanometers measured across the longest axis of the particle. Commercial examples of colloidal silica can be found under the trade names LUDOX® and REMASOL® (e.g., from Remet® Corporation, Utica, N.Y.)

The amount of colloidal silica present in the composition will depend on various factors such as, for example, the amount of aluminum powder being used and the amount of an optional organic stabilizer, as described below. Processing conditions are also a consideration, for examples, how the slurry is formed and applied to a substrate. In one embodiment, the colloidal silica is present in an amount of about 1% by weight to about 40% by weight, based on silica solids as a percentage of the entire composition. Specifically, the colloidal silica is present in an amount of 5% by weight to about 20% by weight, based on silica solids as a percentage of the entire composition. More specifically, the colloidal silica is present in an amount of about 10% by weight to about 15% by weight, based on silica solids as a percentage of the entire composition.

In another embodiment, the slurry composition comprises an organic stabilizer. The stabilizer comprises an organic compound having two or more hydroxyl groups. In one embodiment, the stabilizer contains at least three hydroxyl groups. In one embodiment, the stabilizer is miscible in water. Moreover, a combination of two or more organic compounds could be used as the stabilizer.

Many organic compounds can be used as a stabilizer. Suitable examples include diols (sometimes referred to as "dihydroxy alcohols") such as ethanediol, propanediol, butanediol, cyclopentanediol, glycol and the like, or a combination comprising at least one of the following diols. Suitable glycols include ethylene glycol, propylene glycol, diethylene glycol, and the like, or a combination comprising at least one of the following glycols. The diols can be substituted with various organic groups, including alkyl or aromatic groups. Suitable examples of substituted diols include 2-methyl-1,2-propanediol, 2,3-dimethyl-2,3-butanediol, 1-phenyl -1,2-ethanediol, and 1-phenyl-1,2-propanediol. Organic compounds having three hydroxyl groups can also be used, such as for example, glycerol, $C_3H_5(OH)_3$.

Compounds containing greater than three hydroxyl groups (some of which are referred to as "sugar alcohols") can also be used. As an example, pentaerythritol, $C(CH_2OH)_4$, can be a suitable stabilizer. Sorbitol and similar polyhydroxy alcohols represent other examples.

Various polymeric materials containing two or more hydroxyl groups can also be employed as the organic stabilizer. Suitable examples include various fats (glycerides), such as phosphatidic acid (a phosphoglyceride). Carbohydrates represent another broad class of materials that may be employed. The term "carbohydrate" is meant to include polyhydroxy aldehydes, polyhydroxy ketones, or compounds that can be hydrolyzed to form polyhydroxy aldehydes or polyhydroxy ketones. The term includes materials like lactose, along with sugars, such as glucose, sucrose, and fructose. Many related compounds could also be used, including polysaccharides like cellulose and starch, or components within the polysaccharides, such as amylose. Water-soluble derivatives of the polymeric materials can also be used.

Exemplary organic stabilizers are glycerols and dihydroxy alcohols, such as glycols. Without being bound by theory, it appears that the tri-hydroxy functionality of polyol compounds like glycerol and the dihydroxy functionality of diol compounds are effective at passivating the aluminum component in the slurry.

The amount of the organic stabilizer present in the slurry will depend on various factors, including the specific type of stabilizer present; the hydroxyl content of the stabilizer; its water-miscibility; the effect of the stabilizer on the viscosity of the slurry composition; the amount of aluminum present in the slurry composition; the particle size of the aluminum; the surface-to-volume ratio of the aluminum particles; the specific technique used to prepare the slurry; and the identity of the other components which may be present in the slurry composition. In one embodiment, the slurry comprises a organic stabilizer in an amount sufficient to prevent or minimize undesirable reactions between the aluminum metal and phosphoric acid, when the phosphoric acid is present.

In one embodiment, the organic stabilizer is present in an amount sufficient to chemically stabilize the aluminum or aluminum-silicon component during contact with water or any other aqueous components. The term "chemically stabilize" is used herein to indicate that the slurry remains substantially free of undesirable chemical reactions. Undesirable chemical reaction include reactions that would increase the viscosity and/or the temperature of the composition to unacceptable levels. For example, unacceptable increases in temperature or viscosity are those that could prevent the slurry composition from being easily applied to the substrate.

The amount of organic stabilizer present in the slurry composition is about 0.1% by weight to about 20% by weight, based on the total weight of the composition. Specifically, the amount of organic stabilizer present in the slurry composition is about 0.5% by weight to about 15% by weight, based on the total weight of the composition. More specifically, the amount of organic stabilizer present in the slurry composition is about 1% by weight to about 10% by weight, based on the total weight of the composition.

The slurry composition comprises a liquid carrier. In one embodiment, the amount of liquid carrier employed is the minimum amount sufficient to keep the solid components of the slurry in suspension. Amounts greater than that level may be used to adjust the viscosity of the slurry composition, depending on the technique used to apply the composition to a substrate. In one embodiment, the liquid carrier is present in an amount of about 30% by weight to about 70% by weight, based on the weight of the entire slurry composition. In another embodiment, the slurry could be in the form of a liquid-liquid emulsion.

In one embodiment, the slurry composition is aqueous and comprises a liquid carrier that comprises water. As used herein, "aqueous" refers to compositions in which about 65% or more of the volatile components are water. Specifically, about 75% or more of the volatile components are water. More specifically, about 85% or more of the volatile components are water.

Thus, a limited amount of other liquids may be used in admixture with the water in an aqueous slurry composition. Suitable examples of the other liquids or "carriers" include alcohols, including lower alcohols with 1-4 carbon atoms in the main chain, such as ethanol. Another example of a suitable liquid carrier is a halogenated hydrocarbon solvent. Selection of a particular carrier composition will depend on various factors, such as: the evaporation rate during treatment of the substrate with the slurry; the effect of the carrier on the adhesion of the slurry to the substrate; the solubility of additives and other components in the carrier; the "dispersability" of powders in the carrier; and the carrier's ability to wet the substrate and modify the rheology of the slurry composition. In one embodiment, the aqueous slurry composition comprises a binder comprising colloidal silica.

In one embodiment, the slurry composition is an organic-based composition and comprises a binder that comprises an organic resin. As used herein, an organic-based composition is meant to describe a material that comprises a synthetic resin or drying oil as a film-forming component, and a solvent. In one embodiment the organic-based slurry composition is a commercial coating or a paint. In one embodiment, the organic-based slurry composition further comprises a pigment. In one embodiment, the organic-based slurry composition is non-aqueous. As used herein, non-aqueous refers to a slurry composition that comprises no water or only limited amounts of water.

Suitable examples of useful organic resins include: epoxy resins, silicone resins, alkyd resins, acrylic resins, polyurethane resins, polyvinyl chloride resins, phenolic resins, polyester resins, urethane resins, polyamide resins, polyolefin resins, and the like, or a combination comprising at least one of the foregoing organic resins. An exemplary epoxy resin is bisphenol A. Exemplary silicone resins include modified or unmodified silicone varnish, an organopolysiloxane, a silicone alkyd, a silicone epoxy, or a silicone polyester. An exemplary alkyd resin is the reaction product of phthalic anhydride and glycerol. In one embodiment, the organic-based slurry composition comprises an organic solvent. Suitable examples of suitable organic solvents include alcohols, glycols, ketones, aldehydes, aromatic compounds, dimethylformamide, mineral spirits, naphtha, nitrated hydrocarbons, chlorinated hydrocarbons, and the like, or a combination comprising at least one of the foregoing organic solvents.

In one embodiment, the slurry composition further comprises inert organic pyrolysable thickener particles. As used herein "pyrolysable" means capable of thermal decomposition. In one embodiment, the inert pyrolysable thickener comprises a solid organic particulate thickener. In one embodiment, the inert organic pyrolysable thickeners are inert, occupy space, are capable of vaporizing without leaving residue, and are environmentally benign. By varying the consistency (the amount, for example) of inert organic pyrolysable thickener particles, the resulting material properties can changed. For example, increased amounts of inert organic pyrolysable thickener can increase the firmness of the composition. Suitable materials for the inert organic pyrolysable thickener include (meth)acrylics and poly((meth)acrylics). An exemplary material is poly(methyl methacrylate). Suitable forms for the inert organic pyrolysable thickener include beads, microbeads, yarns, strings, fibers, and combinations thereof. An exemplary form is microbeads. In one embodiment, the average diameter of microbeads is about 200 micrometers. In one example, the inert organic pyrolysable thickener comprises poly(methyl methacrylate) microbeads.

The slurry composition can comprise a variety of other components as additives, for example components that used in the areas of chemical processing and ceramics processing. Suitable examples of these additives are thickening agents, dispersants, deflocculants, anti-settling agents, anti-foaming agents, binders, plasticizers, emollients, surfactants, and lubricants. An exemplary thickening agent is a water soluble polymeric thickener such as polyvinyl alcohol. In one embodiment, the additives are present in an amount of about 0.01% by weight to about 10% by weight, based on the weight of the entire composition.

For embodiments in which the slurry composition is based on colloidal silica and the aluminum-silicon alloy, there are no critical steps in preparing the composition. Commercially available blending equipment can be used, and the shearing viscosity can be adjusted by addition of the liquid carrier. Mixing of the ingredients can be undertaken at a temperature of about 23° C. to about 60° C. Mixing can be done using a hot water bath or other technique to maintain a temperature of about 23° C. to about 60° C. Mixing is carried out until the resulting blend is uniform. The additives mentioned above, if used, can be added after the primary ingredients have been mixed, although this will depend in part on the nature of the additive.

In one embodiment in which the slurry composition comprises an organic stabilizer in conjunction with the powder comprising aluminum and the colloidal silica, the components are blended in a selected sequence. For example, the organic stabilizer is first mixed with the powder comprising aluminum, prior to any significant contact between the powder comprising aluminum and the aqueous carrier. A limited portion of the colloidal silica, for example, one-half or less of the formulated amount, may also be added slowly at this time to enhance the shear characteristics of the mixture. Without being bound by theory, the initial contact between the stabilizer and the aluminum, in the absence of a substantial amount of any aqueous component, may increase the stability of the slurry composition.

The remaining portion of the colloidal silica is then added and thoroughly mixed into the blend. The other optional additives can also be added at this time. In some instances, it may be desirable to wait for a period of time, for example, up to about 24 hours or more, prior to adding the remaining colloidal silica. This waiting period may enhance the "wetting" of the alumina with the stabilizer. Mixing of the remaining ingredients can be undertaken at about 23° C. to about 60° C. Mixing can be done using a hot water bath or other technique to maintain a temperature of about 23° C. to about 60° C. The settling rate of the solid components of the slurry can be controlled by for example, stirring the slurry prior to injection.

In one embodiment, the slurry is manually injected with a syringe into the inside of a passage or cavity of an article. In another embodiment, a feed pump is operated to suck up the slurry from a slurry tank and inject it under pressure into the inside of a passage or cavity of an article. The pressure can be regulated through a flow meter. The pressure of the slurry at the end of the injection is about 0.01 to about 1.0 MPa, specifically about 0.1 to about 0.5 MPa. The slurry is injected at a rate of about 1 to about 200 cc/min. The total amount of slurry injected depends on a variety of factors including the composition and viscosity of the slurry, the superalloy substrate to be coated, the surface area to be covered, and the desired thickness of the coating (although the final diffused aluminide coating thickness is relatively insensitive to the initial slurry coating ("green coating") thickness). In one embodiment, the amount of slurry injected is greater than the amount of slurry that is sufficient to cover the total internal surface area of the passage or cavity. The temperature of the slurry injected into the inside of a passage or cavity of an article is about 23° C. to about 60° C. In one embodiment, a first passage or cavity of an article is masked and the slurry is injected into a second passage or cavity that is left unmasked.

Compressed air is applied to the passage or cavity to distribute the injected slurry throughout the passage or cavity. In one embodiment, the compressed air also expels excess slurry from the passage or cavity. The pressure of the applied compressed air will depend on a variety of factors such as the viscosity, temperature, and volume of the slurry; the size and shape of the passage or cavity; and the superalloy substrate to be coated. The pressure of the compressed air is about 0.01 to about 1.0 MPa, specifically about 0.1 to about 0.5 MPa.

In one embodiment, after the injected slurry has been distributed throughout the passage or cavity, the article is hoisted above the ground to drain out excess slurry. In one embodiment, the article is hoisted above the ground and agitated to drain out excess slurry. In a further embodiment, the article is agitated on a two-axis rotator. A commercially available two-axis rotator is the TURBULA® Shaker-Mixer from Glen Mills, Inc., Clifton, N.J. In one embodiment, the agitation is performed at a temperature of about 23° C. to about 60° C. In one embodiment, the agitation is performed for about one minute to about two hours. Without being bound by theory, the agitation allows further distribution of the slurry within the passage or cavity as well as promotes the removal of excess slurry.

The slurry can be applied as one layer, or as multiple layers. If multiple layers are used, a heat treatment can be performed after each layer is deposited, to accelerate removal of the volatile components. In one embodiment, the heating will also cause decomposition of inert organic pyrolysable thickener particles. After multiple layers of the slurry have been applied, an optional further heat treatment may be carried out, to further remove volatile materials like the organic solvents and water. The heat treatment conditions will depend in part on the identity of the volatile components in the slurry. An exemplary heating regimen is about 5 minutes to about 120 minutes, at a temperature of about 80° C. to about 200° C.

The dried slurry is heated to a temperature sufficient to diffuse the aluminum into the surface region of the substrate, i.e., into the entire surface region, or some portion thereof. As used herein, the "surface region" extends to a depth of about 200 micrometers into the surface, specifically, to a depth of about 120 micrometers into the surface and more specifically, to a depth of about 75 micrometers into the surface. As used herein, an "aluminum-diffused surface region" for substrates like superalloys includes both an aluminum-enriched region closest to the surface, and an area of aluminum-superalloy interdiffusion immediately below the enriched region.

The diffusion temperature for this aluminiding step will depend on various factors, including for example, the composition of the substrate; the specific composition and thickness of the slurry; and the desired depth of enhanced aluminum concentration. In one embodiment, the diffusion temperature is about 650° C. to about 1100° C., and preferably, about 800° C. to about 950° C. These temperatures are also high enough to remove by vaporization or pyrolysis any organic compounds that are present, for example, stabilizers like glycerol. The diffusion heat treatment can be carried out by any convenient technique, such as by heating in an oven in a vacuum or under argon gas.

The time of the diffusion heat treatment will also depend on various factors, including for example, the composition of the substrate; the specific composition and thickness of the slurry; and the desired depth of enhanced aluminum concentration. In one embodiment, the time of the diffusion heat treatment will be about 30 minutes to about 8 hours. In some instances, a graduated heat treatment is desirable. In one embodiment, the temperature is raised to about 650° C., held there for a period of time, and then increased, in steps, to about 850° C. Alternatively, the temperature could initially be raised to a threshold temperature of about 650° C., and then raised continuously, for example at a rate of about 1° C. per minute, to reach a temperature of about 850° C. in 200 minutes.

Removing excess material can be performed by any convenient method. For example, in one embodiment, removing excess material comprises inserting a removing tool in the internal passage or cavity. One example of a removing tool is a needle. In one embodiment, removing excess material comprises dissolving the excess material. In one example, dissolving comprises chemically removing the excess material using sodium hydroxide at 0.5 N (½ mole per liter).

EXAMPLES

Example 1

A slurry is formed by mixing 5 grams (g) of glycerol, 14 g of LP30 colloidal silica, 10 g of 20% (w/w) polyvinyl alcohol (in water), 20 g of 10 to 14 micrometer aluminum powder, 5 g of 10 micrometer aluminum silicon eutectic powder and 2 g of 200 micrometer poly(methyl methacrylate) microbeads. The mixture is injected at room temperature into the trailing edge cooling holes of a 7FA Stage Two nozzle, composed of GTD222 nickel-based superalloy. Compressed air at a pressure of 0.5 MPa was applied for ten minutes. The nozzle was agitated on a TURBULA® Shaker-Mixer at room temperature for ten minutes.

The nozzle is cured according to a three-step heating regimen: 60 minutes at 80° C., then 30 minutes at 120° C., followed by 60 minutes at 230° C. This curing cycle appeared to remove substantially all of the liquid material. After curing, the nozzle is subjected to diffusion heat treatment for the diffusion of the external aluminide coating. The nozzle was heat-treated in a vacuum oven at 650° C. for 15 minutes. The oven temperature was then raised at a rate of 8° C. per minute to 870° C. The oven temperature was held at 870° C. for 2 hours. The nozzle was then oven-cooled. During this treatment the poly(methyl methacrylate) beads decompose to form a gas that escapes from the holes. The powder comprising aluminum is uniformly distributed and diffuses into the superalloy to form a diffusion aluminide coating. Residual aluminum powder is removed mechanically or by brief immersion in 0.5 N sodium hydroxide. The steps are outlined in FIG. 1. As shown in FIG. 2, the internal passage has a substantially uniform coating that is 0.0017-0.0035 inches thick.

Example 2

A slurry is formed as described in Example 1 and maintained at 60° C. in a hot water bath. The mixture is injected at 60° C. into the trailing edge cooling holes of a 7FA Stage Two nozzle, composed of GTD222 nickel-based superalloy. Compressed air at a pressure of 0.5 MPa was applied for ten minutes. The nozzle was agitated on a TURBULA® Shaker-Mixer at 60° C. for ten minutes.

After being air-dried, the nozzle was cured in an oven at 80° C. for 30 minutes, followed by 260° C. for 30 minutes. The nozzle was then diffusion heat-treated in a vacuum oven, at a temperature of about 870° C. for 2 hours. The nozzle was then oven-cooled. During this treatment the poly(methyl methacrylate) beads decompose to form a gas that escapes from the holes. The powder comprising aluminum left behind is uniformly distributed and diffuses into the superalloy to form a diffusion aluminide coating. Residual aluminum powder is removed mechanically or by brief immersion in 0.5 N sodium hydroxide.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A method for aluminizing an internal passage of a metal substrate comprising:

injecting a slurry composition that comprises a powder comprising aluminum, a binder selected from the group consisting of colloidal silica, an organic resin, and a combination thereof, and inert organic pyrolysable thickener particles comprising poly(methyl methacrylate) microbeads, into the internal passage;

applying compressed air to the internal passage to facilitate distribution of the slurry composition throughout the internal passage; and, heat treating the slurry composition under conditions effective to remove volatile components from the composition, and to promote diffusion of aluminum into a surface of the internal passage.

2. The method of claim 1, wherein the injecting of the slurry composition is performed at a temperature of about room temperature to about 60° C.

3. The method of claim 1, further comprising stirring the slurry prior to injection.

4. The method of claim 1, further comprising agitating the metal substrate after the injection of the slurry composition.

5. The method of claim 4, wherein the agitating is performed under conditions sufficient to expel excess injected slurry composition.

6. The method of claim 4, wherein the agitating is performed at a temperature of about room temperature to about 60° C.

7. The method of claim 4, wherein the agitating is performed for about one minute to about two hours.

8. The method of claim 4, wherein the agitating is performed on a two-axis rotator.

9. The method of claim 1, further comprising draining excess injected slurry composition.

10. The method of claim 1, wherein the amount of aluminum in the slurry composition exceeds the amount of aluminum present in the substrate by up to about 65 atomic percent.

11. The method of claim 1, wherein the amount of powder comprising aluminum in the slurry composition is about 10 weight percent to about 90 weight percent.

12. The method of claim 1, wherein the powder comprising aluminum further comprises a metal selected from the group consisting of platinum group metals, rare earth metals, scandium, yttrium, iron, chromium, cobalt, and a combination comprising at least one of the foregoing metals.

13. The method of claim 1, wherein the powder comprising aluminum has an average particle size of about 0.5 micrometer to about 200 micrometers measured across the longest axis of the particle.

14. The method of claim 1, wherein the powder comprising aluminum comprises particles that are spherical, hollow, porous, rod, plate, flake, fibrous, or a combination comprising at least one of the foregoing particles.

15. The method of claim 1, wherein the powder comprising aluminum comprises an alloy of aluminum and silicon.

16. The method of claim 1, wherein the slurry composition further comprises a liquid carrier.

17. The method of claim 1, wherein the binder comprises colloidal silica.

18. The method of claim 1, wherein the colloidal silica is present at a level in the range of about 5% by weight to about 20% by weight, based on silica solids as a percentage of the entire composition.

19. The method of claim 1, wherein the silica in the colloidal silica has an average particle size of about 10 nanometers to about 100 nanometers measured across the longest axis of the particle.

20. The method of claim 1, wherein the colloidal silica comprises particles that are spherical, hollow, porous, rod, plate, flake, fibrous, or a combination comprising at least one of the foregoing particles.

21. The method of claim 1, wherein the heat treating is performed under conditions that are sufficient to cause decomposition of the inert organic pyrolysable thickener particles.

22. The method of claim 1, wherein the removing of the volatile components is further accomplished by mechanically removing the excess material, dissolving the excess material, or a combination thereof.

23. The method of claim 1, wherein the slurry composition further comprises a liquid carrier selected from the group consisting of water, alcohols, halogenated hydrocarbon solvents, and compatible mixtures thereof.

24. The method of claim 1, wherein the slurry composition further comprises an organic stabilizer that comprises two or more hydroxyl groups.

25. The method of claim 1, wherein the slurry composition further comprises an organic stabilizer that comprises three or more hydroxyl groups.

26. The method of claim 1, wherein the slurry composition further comprises an organic stabilizer selected from the group consisting of an alkane diol, glycerol, pentaerythritol, a fat, a carbohydrate, and a combination comprising at least one of the foregoing organic compounds.

27. The method of claim 1, wherein the slurry composition further comprises glycerol.

28. The method of claim 1, wherein the slurry composition further comprises an organic stabilizer present in an amount effective to chemically stabilize the powder comprising aluminum during contact with any aqueous component present in the composition.

29. The method of claim 28, wherein the organic stabilizer is present in an amount of about 0.1% by weight to about 20% by weight, based on the total weight of the composition.

30. The method of claim 1, wherein the heat treatment comprises a preliminary heat treatment to remove the volatile components, and a final heat treatment to diffuse the aluminum into the substrate.

31. The method of claim 1, wherein the heat treatment is carried out at a temperature of about 650° C. to about 1100° C.

32. The method of claim 1, wherein the heat treatment comprises a graduated heat treatment.

33. The method of claim 1, wherein the surface of the substrate extends to a depth of about 200 micrometers into the substrate.

34. The method of claim 1, further comprising removing excess material from the internal passage.

35. The method of claim 1, wherein the substrate is a turbine engine component.

* * * * *